US005220386A

United States Patent [19]

Aoki et al.

[11] Patent Number: 5,220,386

[45] Date of Patent: Jun. 15, 1993

[54] IMAGE FORMING APPARATUS HAVING CLEANABLE TRANSFER MATERIAL CARRYING MEANS

[75] Inventors: Takao Aoki, Abiko; Motoi Katoh; Fumihiro Ueno, both of Yokohama, all of Japan

[73] Assignee: Canon Kabushiki Kaisha, Tokyo, Japan

[21] Appl. No.: 751,996

[22] Filed: Aug. 29, 1991

[30] Foreign Application Priority Data

Aug. 31, 1990 [JP] Japan ..... 2-228410

[51] Int. Cl.[5] ..... G03G 15/14; G03G 21/00

[52] U.S. Cl. ..... 355/273; 355/210; 355/296

[58] Field of Search ..... 355/296, 297, 303, 299, 355/271, 273, 210

[56] References Cited

U.S. PATENT DOCUMENTS 4,734,762 3/1988 Aoki et al. ..... 358/80
4,899,198 2/1990 Mahoney ..... 355/297
4,937,664 6/1990 Chiku et al. ..... 358/75
5,030,988 7/1991 Haneda et al. ..... 355/200
5,038,173 8/1991 Kusumoto ..... 355/296 X
5,070,370 12/1991 Beilis ..... 355/271
5,079,597 1/1992 Mauer et al. ..... 355/296 X

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus for forming an image on a transfer material includes: an image bearing member; a device for forming an image on the image bearing member; a developing device for developing the image into a developed image; a transfer material carrying device; an image transfer device; and a cleaner. The developing device is detachably mounted to the image forming apparatus. The cleaner cleans the transfer material carrying device when the developing device is mounted to the main assembly.

39 Claims, 4 Drawing Sheets

IMAGE FORMING APPARATUS HAVING CLEANABLE TRANSFER MATERIAL CARRYING MEANS

FIELD OF THE INVENTION AND RELATED ART

The present invention relates to an image forming apparatus for forming a superposed image on a transfer material, more particularly to such an apparatus of a color electrophotographic copying type or a color laser beam printer or the like.

A multi-color image forming apparatus is known wherein a plurality of developing devices and an electrophotographic photosensitive drum or drums (image bearing member) or the like are contained as a unit in a process cartridge which is detachably mountable to a main assembly of the image forming apparatus.

The process cartridge is removed as a unit from the main assembly when the service life of the process cartridge ends or when the toner in the developing device is used up. By doing so, the maintenance operations of the machine are so easy that the maintenance operation is possible by the user without relying on a service man having expert experience. In addition, when a transfer material is jammed in the apparatus, the jam clearance operation is easy because it can be carried out after the process cartridge is removed.

However, the process cartridge involves a problem that the toner (developer) in the developing device or devices leaks to the photosensitive drum due to the shocks when it is mounted to or dismounted from the main assembly. The leaked toner is deposited, with the rotation of the photosensitive drum, onto a rotatable transfer drum for supporting the transfer material to receive the toner image from the photosensitive drum. If this occurs, the backside of the transfer material is contaminated, and the proper bias electric field application is obstructed with the result of non-uniform image transfer.

The problem is not peculiar to the process cartridge but is also experienced by a developer cartridge or cartridges which are detachably mountable to the main assembly for the purpose of easy maintenance of the developing device.

SUMMARY OF THE INVENTION

Accordingly, it is a principal object of the present invention to provide an image forming apparatus wherein the developer deposited on the transfer material supporting means is effectively removed without cumbersome manipulation.

It is a further object of the present invention to provide an image forming apparatus wherein the transfer material is prevented from being contaminated with the developer.

According to an aspect of the present invention, there is provided an image forming apparatus for forming a superposed image on a transfer material, comprising: an image bearing member; means for forming an image on said image bearing member; developing means for developing the image into a developed image, said developing means being detachably mountable to a main assembly of said image forming apparatus; transfer material carrying means for carrying a transfer material along an endless path; image transfer means for transferring the developed image from said image bearing member to the transfer material carried on said transfer material carrying means; and cleaning means for cleaning said transfer material carrying means, said cleaning means being operated if said developing means has been mounted to or dismounted from said main assembly after the latest operation thereof.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
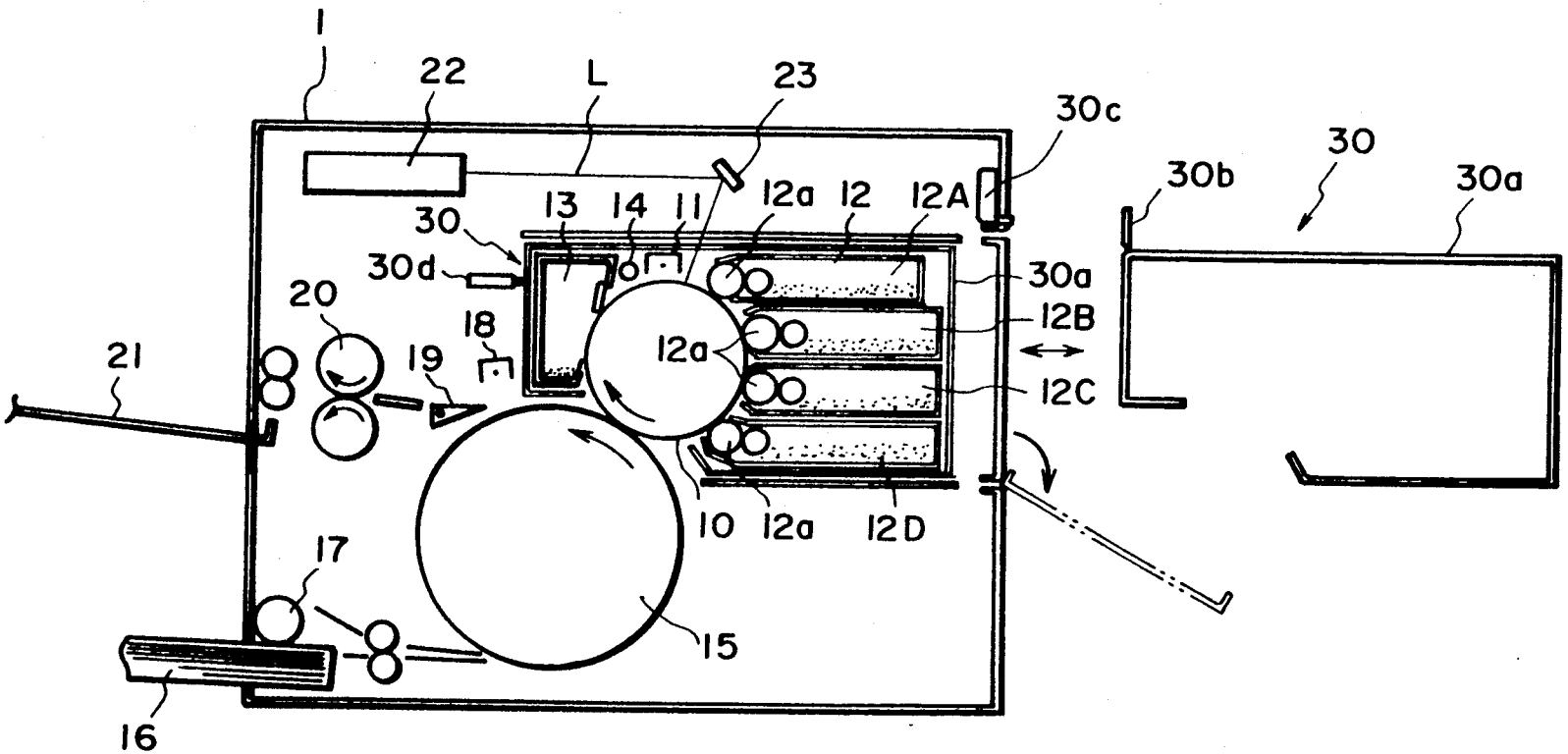
FIG. 1 is a sectional view of an image forming apparatus.

Referring first to FIG. 1, there is shown an image forming apparatus capable of forming a multi-color image by image superposition. It comprises an image bearing member in the form of an electrophotographic photosensitive drum 10 rotatable in the direction indicated by an arrow. Around the periphery of the photosensitive drum 10, there are disposed a charger 11 for charging the photosensitive drum 10 to the negative polarity, a developing device 12A containing yellow toner, a magenta developing device 12B containing magenta toner, a cyan developing device 12C containing cyan toner and a black developing device 12D containing black toner, a cleaning device 13 for removing residual electric charge from the photosensitive drum, a pre-exposure lamp 14 and other process means, and a transfer drum 15.

The yellow, magenta, cyan and black developing devices 12A, 12B, 12C and 12D contain yellow color toner, magenta color toner, cyan color toner and black color toner, respectively. They are selected corresponding to the latent image formed on the photosensitive drum, and a developing sleeve **12*a* of a selected one of the developing devices 12. The developing sleeve 12*a* is supplied with a developing bias voltage having the same polarity as the toner, so that the electrostatic latent image on the photosensitive drum 10 is visualized with the proper color toner in the developing device 12. The toner in the developing device 12** is charged to the negative polarity to effect the reverse development. The charging polarity of the other means is determined so as to meet the polarity of the toner.

The transfer drum 15 comprises a metal cylinder, an elastic layer of resin material on the periphery thereof, a conductive layer for applying an image transfer bias voltage thereon and a dielectric layer thereon. It functions to electrostatically attracts thereon a transfer material (plain paper) and rotates it in contact with the photosensitive drum 10, so that the toner image is electrostatically transferred from the photosensitive drum 10 to the transfer material.

At the transfer material feeding side of the transfer drum 15, there are disposed a transfer material feeding cassette 16, a transfer material (sheet) feeding roller 17 or the like. At the sheet discharging side, there are a separation charger 18 operative when the transfer material is to be separated from the transfer drum, separation pawls 19, a heating roller type fixing device 20 and a sheet discharging tray 21 or the like. The apparatus further comprises a scanning optical system 22 for producing image-modulated beam L (known laser beam) for a predetermined color, and a reflection mirror 23 for directing the beam after the scan to the photosensitive drum.

The image formation process for the multi-color image will be described. The photosensitive drum 10 is uniformly charged to the negative polarity by the charger 11 and is then exposed to the image light L for the yellow color component image (color-separated image) through the scanning optical system 22 or the like, so that an electrostatic latent image of the yellow image component is formed on the photosensitive drum 10. The electrostatic latent image reaches the yellow developing device 12A by the rotation of the photosensitive drum 10, and is visualized with the negatively charged yellow toner into a toner image. Here, the developing sleeves **12*a* of the magenta, cyan and black developing devices 12B, 12C and 12D are supplied with bias voltages of the polarity opposite to that of the toner so as to prevent the developing action from taking place on these developing devices 12**.

The yellow toner images are transferred onto the transfer material supported on the transfer drum 15 supplied to the transfer position in timed relation with the toner image. In this case, the transfer material is wrapped on the transfer drum 15 after being supplied from the sheet cassette 16 by the sheet feeding roller 17 or the like. Immediately before the leading edge of the transfer material reaches the image transfer starting position of the photosensitive drum 10, the image transfer bias of +1.8 KV and having the polarity (positive) which is opposite from that of the toner is applied to the conductive layer of the transfer drum 15, so that the yellow color toner image is transferred onto the transfer material, and in addition, the transfer material is electrostatically attracted on the transfer drum 15. After the image transfer of the yellow toner image, the photosensitive drum 10 is cleaned by the cleaning device 13 so that the residual toner is removed therefrom, and is electrically discharged by the pre-exposure lamp 14 effective to remove the residual charge. Then, it is uniformly charged by the charger 11 for the next image formation and transfer step.

When the photosensitive drum 10 is exposed to the image light L corresponding to the magenta image, an electrostatic latent image for the magenta image is formed on the photosensitive drum 10. The electrostatic latent image is visualized into a toner image by magenta toner from the magenta developing device 15B. The toner image is superposedly transferred onto the transfer material carried on the transfer drum 15. In this case, the transfer drum 15 is supplied with a transfer bias of +2.1 KV, for example, so as to meet the magenta toner.

Similar steps are repeated for the cyan and black image components, and the latent images are formed on the photosensitive drum 10 and are visualized by the cyan and black developing devices 12C and 12D. They are transferred onto the same transfer material superposedly in alignment with the other color component images. In these cases, the transfer drum 15 is supplied with a bias voltage of +2.5 KV, for example, when the cyan toner image is transferred; and when the black toner image is transferred, it is supplied with the voltage of +3.0 KV, for example. In this manner, the transfer bias voltage is increased so as to prevent the decrease of the image transfer efficiency in the superposed transfer.

Thus, a full-color (four color) toner image is formed on the transfer material. Then, the transfer material is subjected to the discharging of the separation charger 18 of an AC corona discharger, so that the electrostatic attraction charge is removed therefrom. Thereafter, it is forcedly separated from the transfer drum 15 by the separation pawl 19 and is conveyed to the fixing device 2, where the toner image is fixed into a permanent image. Finally, the transfer material is discharged to and stacked on the discharge tray 21.

The process means such as the photosensitive drum 10, the charger 11, the yellow developing device 12A, the magenta developing device 12B, the cyan developing device 12C, the black developing device 12D, the cleaning device 13 and the pre-exposure lamp 14 are contained in a cartridge container **30*a* as a unit. The process cartridge 30 is detachably mountable to the main assembly of the image forming apparatus. When, for example, the service life of a process means ends, the process cartridge 30 as a unit is exchanged with a fresh one, so that the maintenance operation is easy. When the transfer material is jammed from the sheet feeding station to the sheet discharging station, the process cartridge 30** is removed so as to facilitate the jam clearance manipulation.

When the process cartridge 30 is mounted to or demounted from the main assembly 1, the mounting or demounting shock may result in leakage of the toner in the developing device 12A (possibly including carrier particles in the case of the two component developer) from the developing sleeve **12*a* side to the photosensitive drum 10. Then, the photosensitive drum 10 is contaminated with the toner. The leaked toner on the photosensitive drum 10 is removed by the cleaning device 13 with the rotation of the photosensitive drum 10, and therefore, is not influential to the image forming operation on the photosensitive drum 10. If, however, the leaked toner is deposited on the transfer drum 15 which rotates in contact with the photosensitive drum 10**, the backside of the transfer material may be contaminated, or the improper image transfer occurs.

In consideration of the problems, in this embodiment of the present invention, the outer periphery of the transfer drum 15 is cleaned by the cleaning means, whenever the process cartridge 30 is mounted to the main assembly of the apparatus. The cleaning means may be in the form of a fur brush or elastic blade or the like contacted to the transfer drum 15. In this embodiment, however, the cleaning function is given to the photosensitive drum 10.

This will be described in more detail. First, the description will be made with respect to the case in which the transfer material is not on the transfer drum. The surface of the photosensitive drum 10 is electrically discharged by the pre-exposure lamp 14 so that the potential thereof comes close to 0 V. The photosensitive drum 10 is not charged by the charger 11 so as to provide the photosensitive drum 10 with easy toner attraction state. On the other hand, the bias voltage supplied to the transfer drum 15 is switched to −2.5 KV (the same polarity as the toner, that is, the negative polarity in this example) by an unshown transfer high voltage control means.

When the photosensitive drum 10 and the transfer drum 15 rotate under the above-described conditions, even if the leaked toner from the developing device 12, if any, is deposited on the photosensitive drum 10, the toner is removed by the cleaning device 13, without being deposited onto the transfer drum 15. Additionally, even if the toner leaked from the developing device 12 is directly deposited on the transfer drum 15 or even if the leaked toner on the photosensitive drum 10 is deposited on the transfer drum 15, the toner on the transfer drum 15 is transferred to the photosensitive drum 10 during several turns of the photosensitive drum 10 or the transfer drum 15, whereby the transfer drum 15 is properly cleaned.

Figure 2:
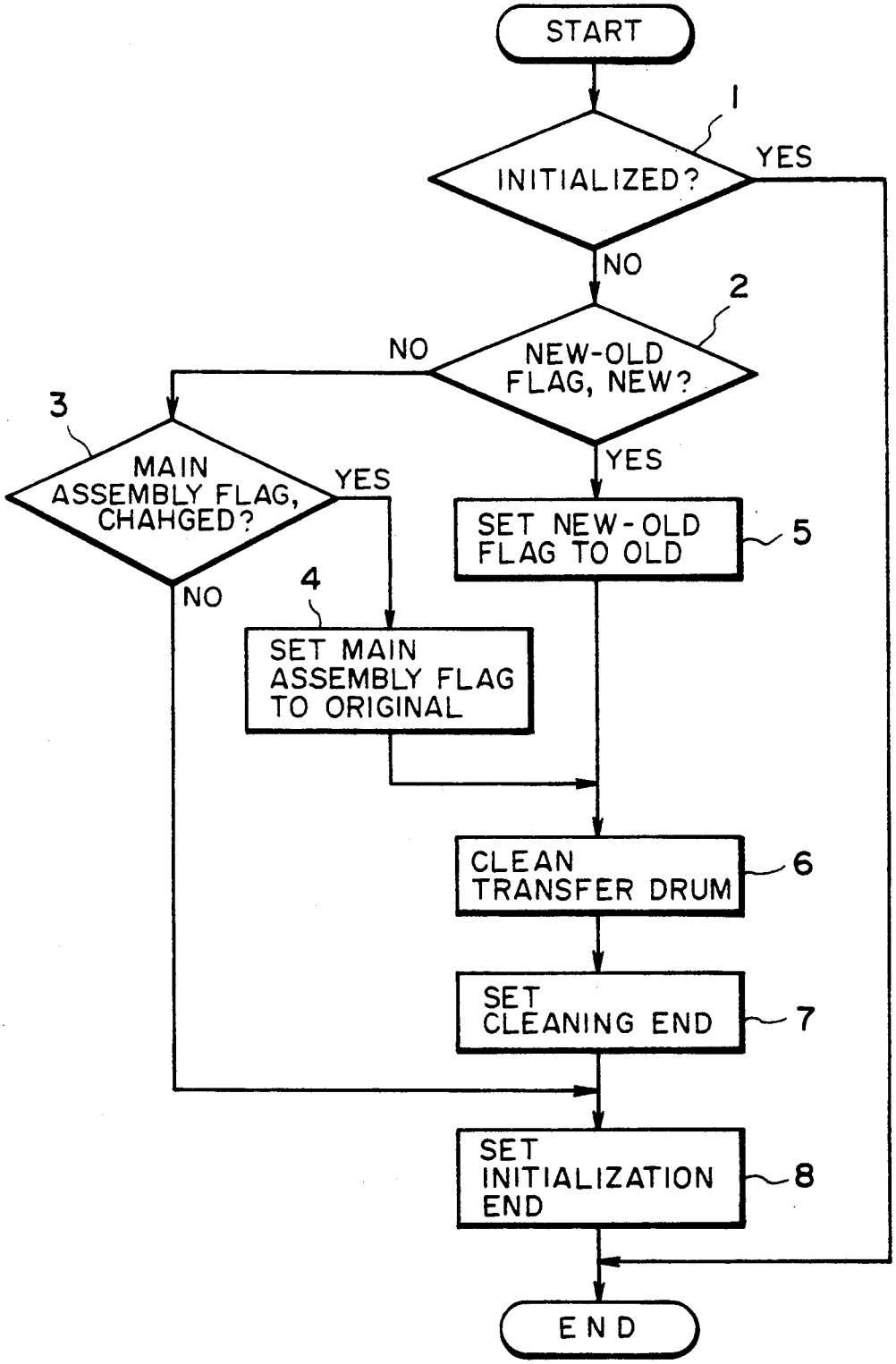
FIGS. 2 and 3 are flow charts for the cleaning operation for the transfer drum.

Referring to FIG. 2, the description will be made as to the cleaning timing for the transfer drum 15 when the process cartridge 30 is mounted to the main assembly 1. The mounting and demounting of the process cartridge 30 relative to the main assembly 1 are detected by a memory circuit in the main assembly 1, irrespective of the on or off state of the main switch of the main assembly 1.

When the main switch of the main assembly 1 is actuated, the discrimination is first made as to whether or not the initialization has been carried out, at step 1. If the result of the discrimination is negative, the discrimination is further made as to whether or not the process cartridge 30 loaded in the main assembly 1 is an unused (fresh) one, at step 2. For permitting this discrimination, the process cartridge is provided with a pawl 30*b*, for example, which is broken when the process cartridge 30 is first mounted to the main assembly 1, and simultaneously, a switch 30*c* of the main assembly 1 is actuated, upon which a new-old flag is set (new). When the partly used process cartridge 30 now having the broken (folded) pawl is mounted into the main assembly 1, the switch 30*c* is not actuated, and only the switch 30*d* is actuated, and the new-old flag remains unchanged (old). The new-old discrimination for the process cartridge 30 is to provide the toner consumption measurement start reference for the developing device 12.

If the process cartridge 30 is discriminated as having been started to use, at step 2, the discrimination is made as to whether or not the process cartridge 30 is mounted to or demounted from the main assembly 1, at step 3. For this discrimination, main assembly flags which are switched upon the mounting of the process cartridge 30 into the main assembly and the dismounting thereof, respectively, are provided. The discrimination is made on the basis of change or non-change of the main assembly flags. When the main assembly flag changes (the process cartridge 30 is mounted), the decision at step 3 is affirmative. Then, the main assembly flag is reset to the original (step 4), and the cleaning operation for the transfer drum 15 is carried out (step 6). After the completion of the cleaning operation, the completion of the cleaning operation is stored (step 7), and in addition, the completion of the initialization is also stored (step 8).

When the discrimination at step 3 is negative, that is, the process cartridge 30 is not mounted or dismounted, the operation returns to the step 8, and the completion of the initialization is deemed. If the result of the discrimination at step 2 is affirmative (unused cartridge), the new-old flag is set to "old" (step 5). Then, the transfer drum 15 is cleaned (step 7). Upon completion of the cleaning operation, the completion of the cleaning is deemed (step 6), and the completion of the initialization is stored (step 8).

As long as the main switch is in the on-state, the completion of the initialization is discriminated (step 1). However, in the second and subsequent discriminations, the completion of the initialization is stored, and therefore, the results of the discrimination is affirmative, so as to the operation skips to the end, and then returned to the start, thus repeating the loop of the operations. When the main switch is once deactuated and then actuated, the steps 1 and 2 are executed in the manner described in the foregoing.

Figure 3:
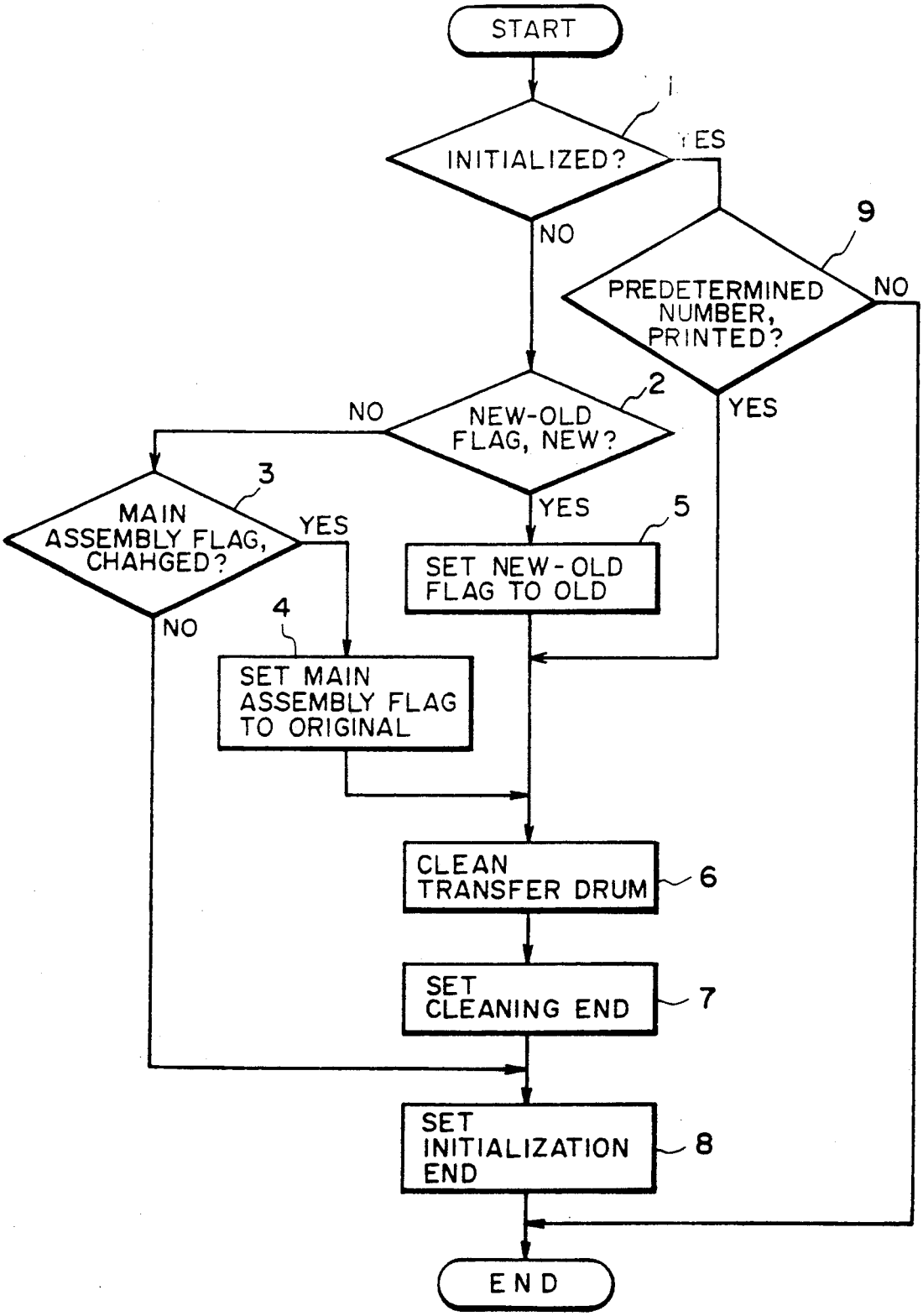

When 100 or 500 image forming operations are carried out while the main switch is kept on-state, the discrimination is made as to whether or not a predetermined number of prints is reached at step 9 in FIG. 3. If it is reached to the predetermined number, the transfer drum 15 may be cleaned (step 6). In this case, the process cartridge 30 is not mounted or demounted, but it is advantageous in that the toner scattered from the developing device 12 during the developing operation is deposited on the transfer drum 15 during the non-printing with the result of contamination of the transfer drum 15.

In the foregoing description, the process cartridge 30 contains the charger 11 or the pre-exposure lamp 14. However, the present invention is applicable to the case of not having these means.

Figure 4:
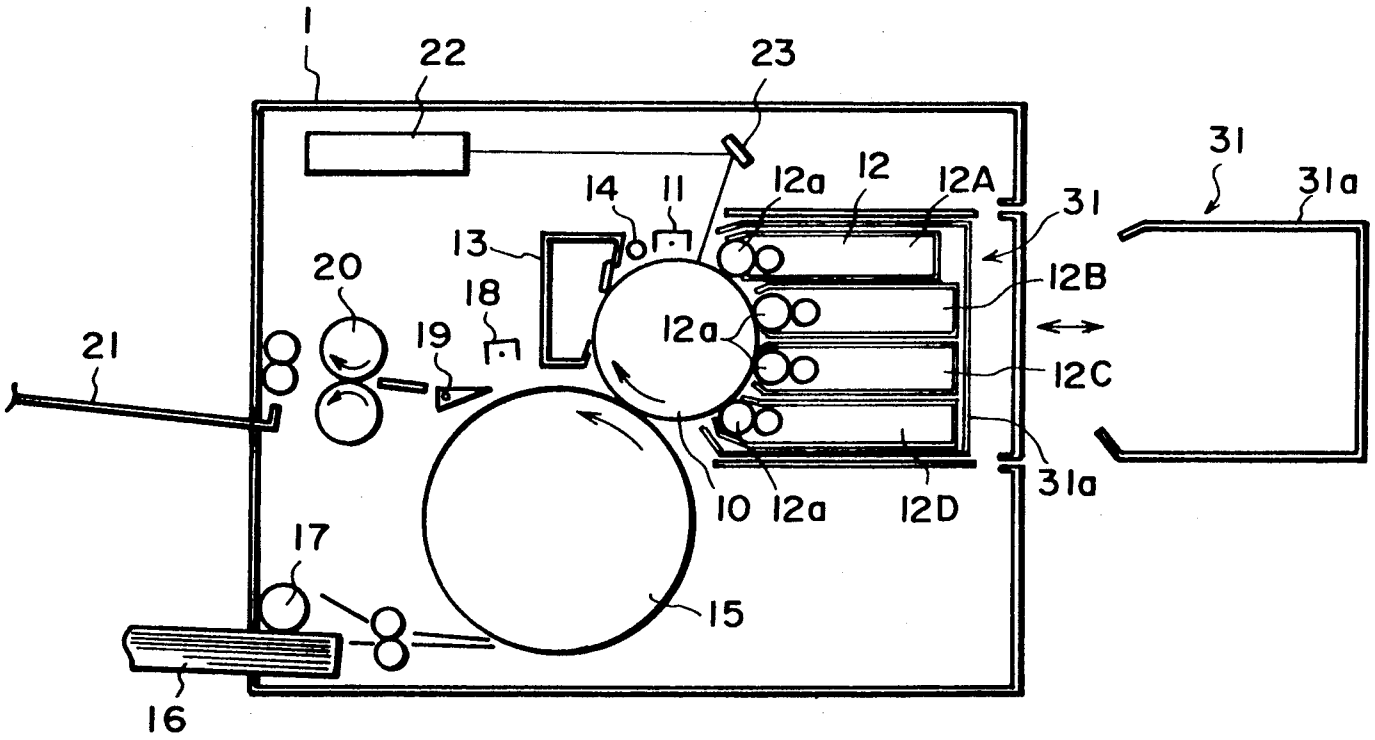
FIG. 4 is a sectional view of an image forming apparatus according to a modified embodiment of the present invention.

As shown in FIG. 4, the same problem as with the process cartridge 30 having the structure described above arises in the case of a developer cartridge 31 which is detachably mountable to the main assembly 1 and which contains as a unit only the yellow developing device 12A, the magenta developing device 12B, the cyan developing device 12D and the black developing device 12D. Therefore, the transfer drum 15 may be cleaned in the same manner after the mounting or demounting of the developer cartridge 31. Each of the developing devices 12 in the developer cartridge 31 may be in the form of a subordinate cartridge detachably mountable to the developer cartridge 31. Otherwise, each of the developing device 12 may be in the form of a developer cartridge detachably mountable directly to the main assembly 1. The present invention is applicable to these cases, too.

As will be understood from the foregoing, according to the embodiments of the present invention, even if the developer is leaked from the developing means upon the mounting or demounting of the developer cartridge or the process cartridge, and the transfer material carrying member is contaminated with the developer, the various troubles arising from the deposition of the developer on the transfer material carrying member can be avoided because of the provision of the cleaning means for cleaning the transfer material carrying member.

If the cartridge 30*a* is taken out during the printing for one reason or another, the transfer drum is not contaminated because of the existence of the transfer material on the transfer drum even if the toner is leaked. Therefore, the cleaning step may be omitted on the basis of the discrimination by the control circuit if the cartridge is demounted from the main assembly during the printing operation.

In the foregoing embodiment, the printing machine is taken. However, the present invention is applicable to a copying machine wherein an original image is picked up by a picture taking element such as CCD or the like to convert the image to electric signals, which in turn is supplied to the scanning means 22 or wherein the original image is optically color-separated and are directly projected onto the photosensitive drum through an optical system.

In the foregoing embodiments, the multi-color image is a full-color image, but the image may be a superposed image of a black image and a single color non-black image. The superposition of the images has been described as being accomplished by repeating the development and transfer of the image. However, the present invention is applicable to the conventional process wherein the superposed toner image is formed on the photosensitive drum during one full turn of the photosensitive drum, and the superposed toner images are transferred onto the transfer material at once.

The process cartridge may contain a photosensitive member and a developing device; a photosensitive member, a charging means and a developing device, for example, as long as the image forming apparatus comprises a transfer material carrying means.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image on a transfer material, comprising:

an image bearing member;

latent image forming means for forming a latent image on said image bearing member;

developing means for developing the latent image formed on said image bearing member, said developing means being detachably mountable to a main assembly of said image forming apparatus;

transfer material carrying means for carrying the transfer material thereon;

transfer means for transferring the developed image from said image bearing member onto the transfer material carried on said transfer material carrying means; and control means for initiating a cleaning operation for said transfer material carrying means in response to mounting of said developing means to said main assembly.

2. An apparatus according to claim 1, wherein said developing means is mounted above said transfer material carrying means.

3. An apparatus according to claim 1, wherein said developing means is mounted above a horizontal line passing through an axis of said transfer material carrying means.

4. An apparatus according to claim 1, wherein said control means includes a memory circuit in said main assembly.

5. An apparatus according to claim 1, wherein said transfer material carrying means comprises a metal cylinder having an elastic layer on the surface thereof, a conductive layer thereon and a dielectric layer thereon, wherein said transfer material carrying means carries the transfer material electrostatically.

6. An apparatus according to claim 1, wherein said developing means comprises a yellow developing means for effecting development operation with yellow toner, a magenta developing means for effecting development operation with magenta toner, a cyan developing means for effecting development operation with cyan toner and a black developing means for effecting developing operation with black toner.

7. An apparatus according to claim 1, wherein said developing means comprises a first developing means for effecting development operation with a first toner and a second developing means for effecting development operation with a second toner having a color different from that of the first toner.

8. An apparatus according to claim 1, wherein said developing means comprises a yellow developing means for effecting development operation with yellow toner.

9. An apparatus according to claim 1, wherein said developing means comprises a magenta developing means for effecting development operation with magenta toner.

10. An apparatus according to claim 1, wherein said development means comprises a cyan developing means for effecting development operation with cyan toner.

11. An apparatus according to claim 1, wherein said developing means comprises a black developing means for effecting development operation with black toner.

12. An apparatus according to claim 1, wherein said image forming apparatus is a color electrophotographic apparatus.

13. An apparatus according to claim 1, wherein said image forming apparatus is a color laser beam printer.

14. An apparatus according to claim 1, wherein said image bearing member functions as a part of said cleaning means.

15. An apparatus according to claim 1, wherein during the cleaning operation by said cleaning means, said transfer means is supplied with a bias voltage of the same polarity as the charging polarity of a developer so that the developer is transferred from said transfer material carrying means to said image bearing member.

16. An apparatus according to claim 1, wherein said cleaning means is operated after a predetermined number of image forming operations is carried out.

17. An apparatus according to claim 1, wherein said image forming means, said developing means and said image transfer means are repeatedly operated for the respective colors of said developers, so that a color superposed image is formed on the transfer material carried on said transfer material carrying means.

18. An apparatus according to claim 1, wherein the different color developers include yellow, magenta and cyan developers.

19. An apparatus according to claim 1, wherein said cleaning means includes a wiping cleaning means.

20. An apparatus according to claim 1, wherein said image bearing member includes a photosensitive member.

21. An image forming apparatus for forming an image on a transfer material, to which a process cartridge is mountable, comprising:

process cartridge mounting means for mounting a process cartridge including an image bearing member, and developing means for developing a latent image formed on said image bearing member;

transfer material carrying means for carrying the transfer material thereon;

transfer means for transferring the developed image from said image bearing member onto the transfer material carried on said transfer material carrying means; and control means for initating a cleaning operation for said transfer material carrying means in response to mounting of said process cartridge to said apparatus.

22. An apparatus according to claim 21, wherein said process cartridge includes charging means for charging said image bearing member in the form of a photosensitive member.

23. An apparatus according to claim 21, wherein said process cartridge includes cleaning means for cleaning said image bearing member in the form of a photosensitive member.

24. An apparatus according to claim 21, wherein said process cartridge includes a pre-exposure lamp for exposing said image bearing member in the form of a photosensitive member to light.

25. An apparatus according to claim 21, wherein said development means comprises a yellow developing means for effecting development operation with yellow toner, a magenta developing means for effecting development operation with magenta toner, a cyan developing means for effecting development operation with cyan toner and a black developing means for effecting developing operation with black toner.

26. An apparatus according to claim 21, wherein said development means comprises a first developing means for effecting development operation with first toner and a second development means for effecting development operation with second toner having a color different from that of the first toner.

27. An apparatus according to claim 21, wherein said developing means comprises a yellow developing means for effecting development operation with yellow toner.

28. An apparatus according to claim 21, wherein said development means comprises a magenta developing means for effecting development operation with magenta toner.

29. An apparatus according to claim 21, wherein said developing means comprises a cyan developing means for effecting development operation with cyan toner.

30. An apparatus according to claim 21, wherein said developing means comprises a black developing means for effecting development operation with black toner.

31. An apparatus according to claim 21, wherein said image forming apparatus is a color electrophotographic apparatus.

32. An apparatus according to claim 21, wherein said image forming apparatus is a color laser beam printer.

33. An apparatus according to claim 21, wherein said image bearing member functions as a part of said cleaning means.

34. An apparatus according to claim 21, wherein during the cleaning operation by said cleaning means, said transfer means is supplied with a bias voltage of the same polarity as the charging polarity of a developer so that the developer is transferred from said transfer material carrying means to said image bearing member.

35. An apparatus according to claim 21, wherein said cleaning means is operated after a predetermined number of image forming operations is carried out.

36. An apparatus according to claim 21, wherein said image forming means, said developing means and said image transfer means are repeatedly operated for the respective colors of said developers, so that a color superposed image is formed on the transfer material carried on said transfer material carrying means.

37. An apparatus according to claim 21, wherein the different color developers include yellow, magenta and cyan developers.

38. An apparatus according to claim 21, wherein said cleaning means includes a wiping cleaning means.

39. An apparatus according to claim 21, wherein said image bearing member includes a photosensitive member.

* * * * *

UNITED STATES PATENT AND TRADEMARK OFFICE

CERTIFICATE OF CORRECTION

PATENT NO. : 5,220,386

DATED : JUNE 15, 1993

INVENTOR(S) : TAKAO AOKI, ET AL.

It is certified that error appears in the above-indentified patent and that said Letters Patent is hereby corrected as shown below:

On drawing sheet:

In Fig. 2, "CHAHGED?" should read --CHANGED?--.
In Fig. 3, "CHAHGED?" should read --CHANGED?--.

COLUMN 2

Line 61, "attracts" should read --attract--.
Line 62, "rotates" should read --rotate--.

COLUMN 6

Line 33, "12D" should read --12C--.

COLUMN 8

Line 2, "developing" should read --development--.
Line 18, "development" should read --developing--.
Line 67, "initating" should read --initiating--.

COLUMN 9

Line 17, "development" should read --developing--.
Line 23, "developing" should read --development--.
Line 25, "development" should read --developing--.

UNITED STATES PATENT AND TRADEMARK OFFICE

CERTIFICATE OF CORRECTION

PATENT NO. : 5,220,386

DATED : June 15, 1993

INVENTOR(S) : Takao Aoki, et al

It is certified that error appears in the above-indentified patent and that said Letters Patent is hereby corrected as shown below:

Column 9, line 27, "development" should read --developing--
line 35, "development" should read --developing--

Signed and Sealed this

Twelfth Day of April, 1994

Bruce Lehman

*Attest:*

BRUCE LEHMAN

*Commissioner of Patents and Trademarks*

*Attesting Officer*